US010709195B2

(12) United States Patent
Li

(10) Patent No.: US 10,709,195 B2
(45) Date of Patent: Jul. 14, 2020

(54) SHOE INSOLE

(71) Applicant: Industech International Inc., Verona, NJ (US)

(72) Inventor: Douglas Li, North Haledon, NJ (US)

(73) Assignee: Industech International Inc., Verona, NJ (US)

( * ) Notice: Subject to any disclaimer, the term of this patent is extended or adjusted under 35 U.S.C. 154(b) by 111 days.

(21) Appl. No.: 15/418,163

(22) Filed: Jan. 27, 2017

(65) Prior Publication Data

US 2017/0258175 A1 Sep. 14, 2017

Related U.S. Application Data

(60) Provisional application No. 62/307,051, filed on Mar. 11, 2016.

(51) Int. Cl.

| | |
|---|---|
| ***A43B 7/14*** | (2006.01) |
| ***A43B 17/02*** | (2006.01) |
| ***A43B 3/00*** | (2006.01) |
| ***A43B 13/40*** | (2006.01) |
| ***A43B 17/14*** | (2006.01) |
| ***A43B 17/18*** | (2006.01) |

(52) U.S. Cl.

CPC ..... *A43B 7/141* (2013.01); *A43B 3/0078* (2013.01); *A43B 7/142* (2013.01); *A43B 7/143* (2013.01); *A43B 7/149* (2013.01); *A43B 13/40* (2013.01); *A43B 17/02* (2013.01); *A43B 17/14* (2013.01); *A43B 17/18* (2013.01)

(58) Field of Classification Search

CPC ..... A43B 3/0078; A43B 7/141; A43B 7/142; A43B 7/143; A43B 7/144; A43B 7/71445; A43B 17/006

USPC ..... 36/145

See application file for complete search history.

(56) References Cited

U.S. PATENT DOCUMENTS 4,109,661 A * 8/1978 Fukuoka ..... A43B 1/0054 36/11.5
5,154,682 A * 10/1992 Kellerman ..... A43B 1/0072 36/178
5,282,326 A * 2/1994 Schroer, Jr. ..... A43B 17/023 36/145

(Continued)

FOREIGN PATENT DOCUMENTS

CA 2439347 A1 3/2004
CN 2922544 Y 7/2007

(Continued)

OTHER PUBLICATIONS

First Office Action in Chinese Application No. 201710128985.X dated Oct. 31, 2019, 15 Pages.

*Primary Examiner* — Sharon M Prange
(74) *Attorney, Agent, or Firm* — Metis IP LLC

(57) ABSTRACT

An insole is provided. This insole features a front end, a thickness, a top surface, a bottom surface, a heel receiving portion having a first end and a second end, a lateral longitudinal arch support section which has a width, and a medial longitudinal arch support section. Preferably, the medial longitudinal arch support section is made up of a partial spherical cap which has a radius and a height, and the medial longitudinal arch support section runs from the first end of said heel receiving portion to the lateral longitudinal arch support section.

13 Claims, 10 Drawing Sheets

(56) References Cited

U.S. PATENT DOCUMENTS

| | | | | |
|---|---|---|---|---|
| 5,611,153 | A * | 3/1997 | Fisher | A43B 7/14 36/173 |
| 6,484,419 | B1 * | 11/2002 | Rohde | A43B 7/141 36/10 |
| 6,557,273 | B2 * | 5/2003 | Polifroni | A43B 7/141 36/145 |
| 6,915,598 | B2 * | 7/2005 | Grisoni | A43B 7/141 36/149 |
| 8,091,254 | B2 * | 1/2012 | Wang | A43B 7/14 36/145 |
| 8,776,399 | B2 * | 7/2014 | Tsai | A43B 17/006 36/145 |
| 9,060,563 | B2 | 6/2015 | Tsai | |
| 9,060,565 | B2 | 6/2015 | Kosta | |
| 9,066,559 | B2 | 6/2015 | Butler | |
| 9,066,790 | B1 | 6/2015 | Fisher | |
| 9,161,591 | B2 | 10/2015 | Landau et al. | |
| 9,232,828 | B2 | 1/2016 | Arlen et al. | |
| 9,232,831 | B2 | 1/2016 | Kimura et al. | |
| 9,243,104 | B2 | 1/2016 | Watkins et al. | |
| 9,493,623 | B2 * | 11/2016 | Shimizu | A43B 13/04 |
| 9,682,003 | B2 * | 6/2017 | Gourineni | A61H 1/0266 |
| 2004/0123498 | A1 * | 7/2004 | Lietzman | A43B 1/0009 36/145 |
| 2008/0184593 | A1 * | 8/2008 | Draghiceanu | A43B 1/0063 36/10 |
| 2010/0269371 | A1 * | 10/2010 | Gray | A43B 7/141 36/43 |
| 2013/0312280 | A1 * | 11/2013 | Gardiner | A43B 1/0009 36/43 |
| 2013/0318818 | A1 * | 12/2013 | Gardiner | A43B 7/141 36/43 |

FOREIGN PATENT DOCUMENTS

| | | | |
|---|---|---|---|
| EP | 0500632 | B1 | 4/1998 |
| WO | 2006104295 | A1 | 10/2006 |

* cited by examiner

SHOE INSOLE

CLAIM OF PRIORITY

This application claims priority to U.S. Application 62/307,051 filed on Mar. 11, 2016 the content of which are hereby fully incorporated by reference in its entirety.

FIELD OF THE EMBODIMENTS

The field of the present invention and its embodiments relate to an insole, and in particular, an insole that helps evenly distribute the weight of a user.

BACKGROUND OF THE EMBODIMENTS

Back problems, knee pain, and foot pain are all slowly becoming ubiquitous in society. As more and more Americans sit behind a desk to earn a living, the average posture of the American public degrades proportionally. This poor posture can lead to a number of different issues, including various foot problems such as callouses, bunions, and ingrown toenails. Further, this poor posture can lead to lower back pain, which is one of the most common ailments amongst Americans over the age of 30.

Typically, when someone experiences these problems, they seek out some sort of insert or insole for their shoe to help correct this problem. These insoles come in a number of different forms. The first, and most common, is the traditional over-the-counter insoles. Frequently found in convenience stores and supermarkets. These types of insoles frequently offer some sort of cushioned or gel-like pad to increase the user's comfort. However, these fail to offer the support needed to meaningfully improve a user's posture. Another type of corrective insole is prescribed to patients who see a podiatrist. These insoles often offer sufficient arch support, but they are so stiff that when worn for an extended period of time they can cause a user to have great discomfort. As such, there remains a need for an insole that can provide sufficient support that is comfortable when worn for extended period of time.

REVIEW OF RELATED TECHNOLOGY

U.S. Pat. No. 5,154,682 pertains to a low friction shoe insert of ultrahigh molecular weight polyethylene or the like having a coefficient of friction of 0.3 or less with an array of detachable discrete cushion elements on the shoe contacting lower surface to both frictionally anchor the insert to the shoe and permit the shape to be customized to the wearers foot and selectively relieve pressure on painful and sensitive areas.

U.S. Pat. No. 9,232,831 pertains to a heel counter structure including a sole plate provided at least at the heel region of the shoe and having a peripheral portion. The peripheral portion is upraised along the heel region of the shoe so as to enclose the lower portion of the heel portion of the foot of the wearer. The heel structure also includes a pair of heel counter portions provided on the medial and lateral sides of the heel region of the shoe so as to sandwich the heel portion of the foot sideways. The heel counter portions are coupled to the peripheral portion of the sole plate at the lower ends of the heel counter portions so that the heel counter portions can tilt inwardly and outwardly independently of the sole plate. The heel counter portions are separated from the peripheral portion of the sole plate except the lower ends of the heel counter portions.

U.S. Pat. No. 9,161,591 pertains to an article of footwear and insert for an article of footwear are provided with means for provisional instantaneous enhancing cutaneous mechanoreceptors pressure sensation from the plantar surface (sole) of the foot perimeter zone. Such instantaneous stimulation ought to compensate age/illness-related deterioration of plantar cutaneous sensation; it enhances its ability to detect and react to the shifts of the body's Center of Gravity (COG) toward the edges of the feet which, if left uncorrected right away, cause ankle sprain, and/or loss of balance and fall. An insole disclosed is provided with a set of pressure activated protrusions, which form a narrow strip in close proximity to the perimeter of the insole inside the inner neighborhood of the plantar sole perimeter, and becomes active just when the Center Of Pressure (COP) of the wearer of the footwear is shifting dangerously toward the edges of the feet.

U.S. Pat. No. 9,232,828 pertains to an article of footwear with customizable stiffness is provided. The article of footwear in the form of a snowboard boot is provided with stiffness elements that are inserted within retaining enclosures disposed on either side of an inner liner of the snowboard boot. Depending on the level of stiffness of the stiffener element, or lack thereof, different flex profiles having varying degrees of stiffness are available to the wearer to customize the stiffness of the snowboard boot when secured within a binding. A kit of parts is also disclosed that includes a pair of boots and two sets of interchangeable stiffener inserts to allow a wearer to customize the stiffness of the boots as desired.

U.S. Pat. No. 9,243,104 pertains to pellets, beads, particles, or other pieces of a thermoplastic elastomer having a maximum size in at least one dimension of 10 mm or less (collectively, "pellets") are infused with a supercritical fluid in a pressurized container, then rapidly depressurized and heated either by immersion in a heated fluid or with infrared or microwave radiation to foam the pellets The pellets are prepared with at least two different densities. Pellets with different densities, thermoplastic elastomer compositions, or foam response rates are placed in different areas of a mold. The mold is filled with pellets, then the pellets are molded into a part. The part has areas of different density as a result of the placement of pellets of different density.

Various systems and methodologies are known in the art. However, their structure and means of operation are substantially different from the present disclosure. The other inventions fail to solve all the problems taught by the present disclosure. The present invention and its embodiments provide a means to improve a user's posture and comfort while on their feet. At least one embodiment of this invention is presented in the drawings below and will be described in more detail herein.

SUMMARY OF THE EMBODIMENTS

The present invention provides for an insole, comprising: a front end; a thickness; a top surface; a bottom surface; a heel receiving portion having a first end and a second end; a lateral longitudinal arch support section, having a width; and a medial longitudinal arch support section, comprising, a partial spherical cap, said spherical cap having a radius and a height, wherein said medial longitudinal arch support section runs from said first end of said heel receiving portion to said lateral longitudinal arch support section. In many preferred embodiments, said insole does not have a toe receiving portion. Preferably, the bottom surface of the insole is disposed with an adhesive. While many materials are suitable, preferably the insole of the present invention will be constructed out of ultra-high molecular weight polyethylene. In some embodiments, padding disposed on said top surface. In some embodiments, text, at least one graphic, or both are disposed on said top surface or said bottom surface of the insole of the present invention.

The present invention also contemplates an insert, comprising: an insole, comprising: a front end; a thickness; a top surface; a bottom surface; a heel receiving portion having a first end and a second end; a lateral longitudinal arch support section, having a width; and a medial longitudinal arch support section, comprising, a partial spherical cap, said spherical cap having a radius, wherein said medial longitudinal arch support section runs from said first end of said heel receiving portion to said lateral longitudinal arch support section; at least one pad, disposed on said top surface; a fabric sleeve, wherein said fabric sleeve envelops said insole. Preferably, this insert is located in a shoe, and is either permanently or temporarily attached to said shoe.

The present invention also teaches a method of producing an insole, comprising synthesizing a sheet of polymer, having a thickness; stamping said sheet, at least one time, with an insole-shaped stamp to create an insole-shaped impression; removing said impression; placing said impression in an arch-shaped mold; and heating said impression such that it will take the shape of said arch-shaped mold. The insole of the present invention operates by supporting a user's body weight directly by enlarging the weight "landing" base on the foot.

In general, the present invention succeeds in conferring the following, and others not mentioned, benefits and objectives.

It is an object of the present invention to improve the posture of a user.

It is an object of the present invention to improve the balance of a user.

It is an object of the present invention to help a user stand taller.

It is an object of the present invention to improve a user's walking.

It is an object of the present invention to provide an insole that can easily fit into a wide variety of shoes.

It is an object of the present invention to provide a light-weight insole.

It is an object of the present invention to provide support to a user's arch.

It is an object of the present invention to increase the comfort of a user.

It is an object of the present invention to reduce lower back fatigue.

It is an object of the present invention to distribute a user's weight over a larger area than the user is accustomed to.

DESCRIPTION OF THE PREFERRED EMBODIMENTS

Figure 1:
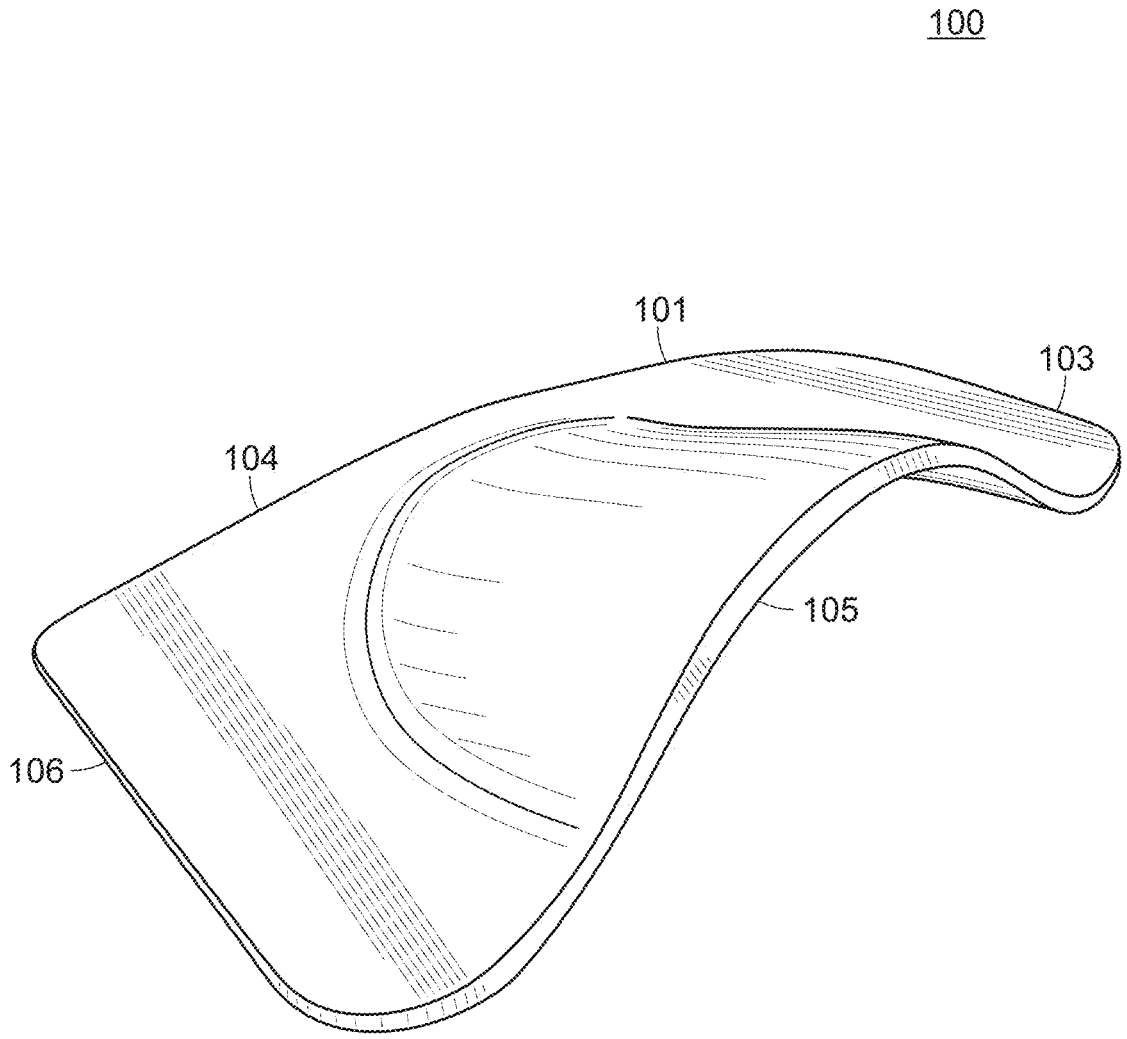
FIG. 1 is a perspective view of an embodiment of the insole of the present invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

As a threshold matter, it should be noted that while FIGS. 1-7 show an insole of the present invention that is adapted to the right foot of a human, there exist many embodiments where the insole of the present invention is adapted for the left foot of a human.

Referring to FIG. 1, a perspective view of an embodiment of the insole of the present invention is shown. Here, insole 100 features top surface 101, heel receiving portion 103, lateral longitudinal arch support section 104, medial longitudinal arch support section 105, and anterior transverse arch support section 106. As their names suggest, lateral longitudinal arch support section 104 is shaped to support the lateral longitudinal arch of a human foot; medial longitudinal arch support section 105 is shaped to support the medial longitudinal arch of a human foot, and anterior transverse arch support section 106 is sized and shaped to support the anterior transverse arch of a human hoot.

Of particular note here is the structure of medial longitudinal arch support section 105. As shown in FIG. 1, medial longitudinal arch support section 105 has an arch height much higher than that of the average human foot. While not mandatory, embodiments with this large arch height are desirable because when in use, they remain in contact with the medial longitudinal arch of a user. This constant contact offers improved arch support when compared to the methods of the prior art. Further, insole 100 is preferably flexible. When insole 100 is flexible and equipped with this large arch height, dramatically superior arch support is achieved. The constant contact prevents the medial longitudinal arch from becoming fatigued, and the flexible nature of insole 100 provides for increased user comfort. The height of the arch in longitudinal arch support section 105 ranges for 0.2 inches to 2 inches. The thickness of insole 100 preferably ranges from 0.06 inches to 0.15 inches. Preferably, the total length of insole 100 will range from 3 inches to 6 inches, depending on the size of a given user's foot, or a manufacturer's preference.

Figure 2:
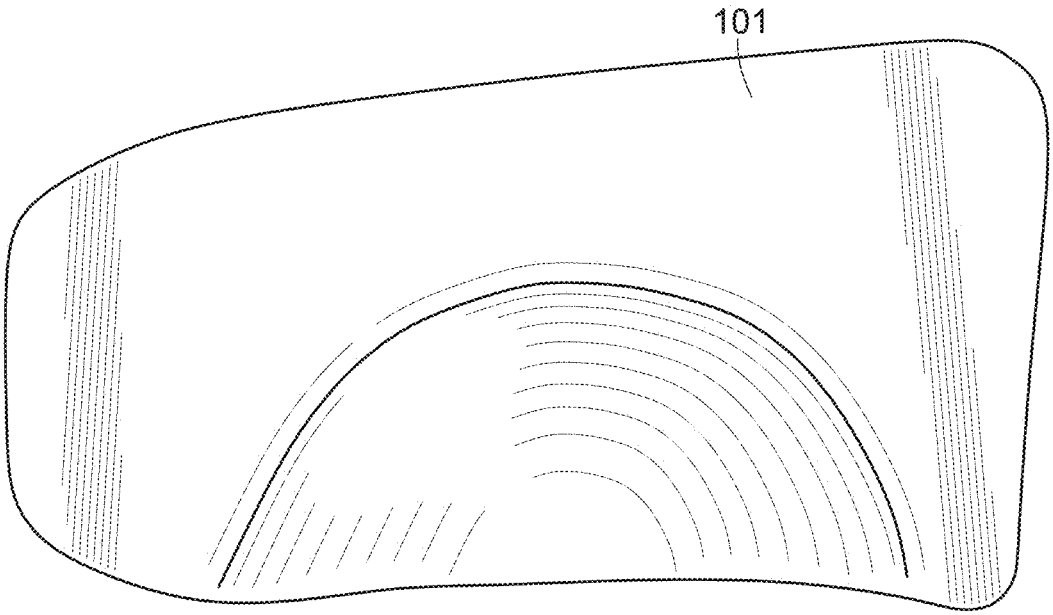
FIG. 2 is a top view of an embodiment of the insole of the present invention.

FIG. 2 shows a top view of an embodiment of the insole of the present invention. Here top surface 101 is shown. Preferably, this surface is smooth, but it may be slightly textured. Here, top surface 101 is bare, but in alternative embodiments, various, graphics, texts, advertisements, or some combination thereof may be disposed on said top surface.

Figure 3:
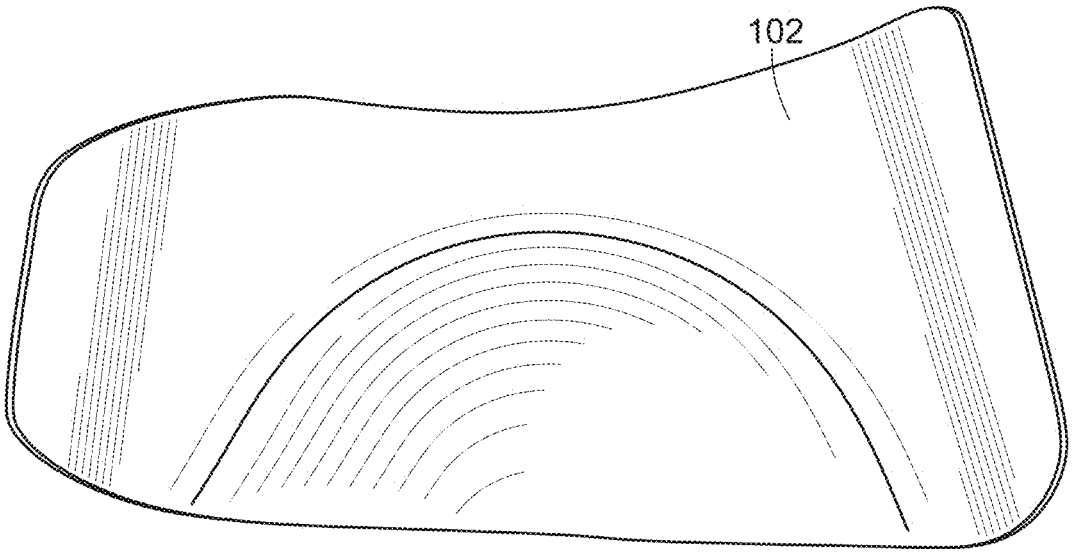
FIG. 3 is a bottom view of an embodiment of the insole of the present invention.
Figure 4:
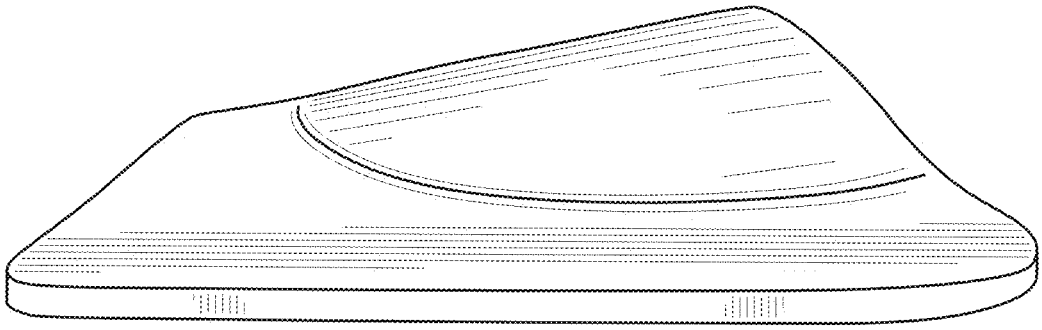
FIG. 4 is a front view of an embodiment of the insole of the present invention.
Figure 5:
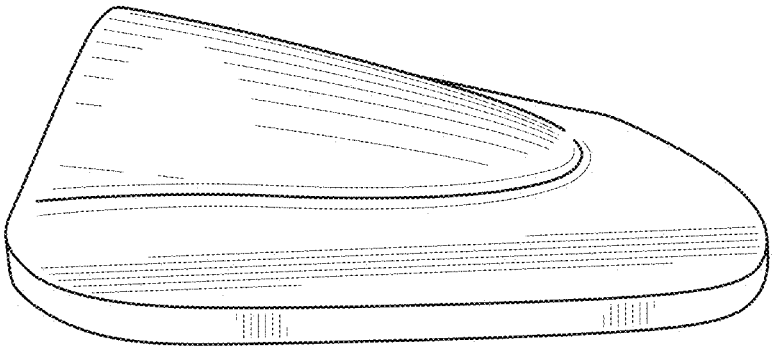
FIG. 5 is a rear view of an embodiment of the insole of the present invention.
Figure 6:
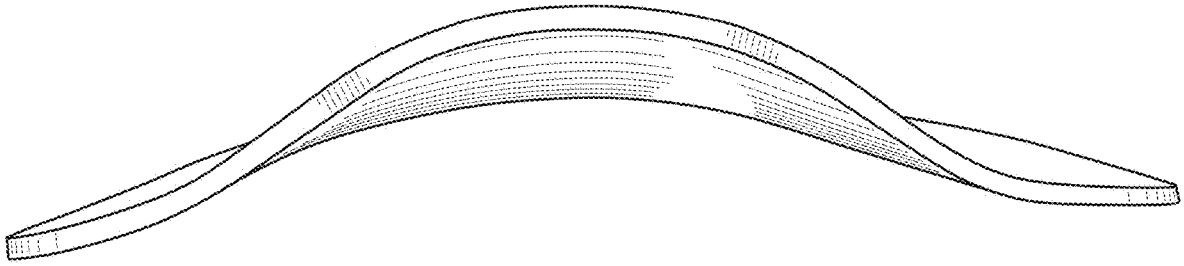
FIG. 6 is a left side view of an embodiment of the insole of the present invention.
Figure 7:
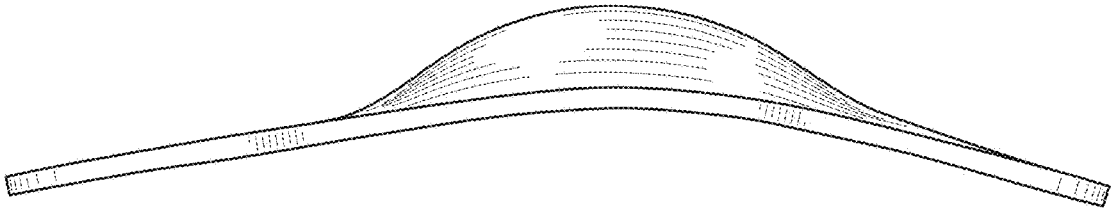
FIG. 7 is a right side view of an embodiment of the insole of the present invention.

FIG. 3 shows a bottom view of an embodiment of the insole of the present invention. Here, bottom surface 102 is shown. Bottom surface 102 may be smooth, may be textured, or may have some adhesive disposed thereon. While many adhesives are suitable for use with the present invention, preferably the present invention will be used with a mild adhesive, such that the present invention will not slide around a user's shoe, but will also be readily removable from said shoe.

FIGS. 4-7 show various views of an embodiment of the insole of the present invention. As the insole of the present invention is of a unique shape, these views are added to fully define the contours of that embodiment.

Figure 8:
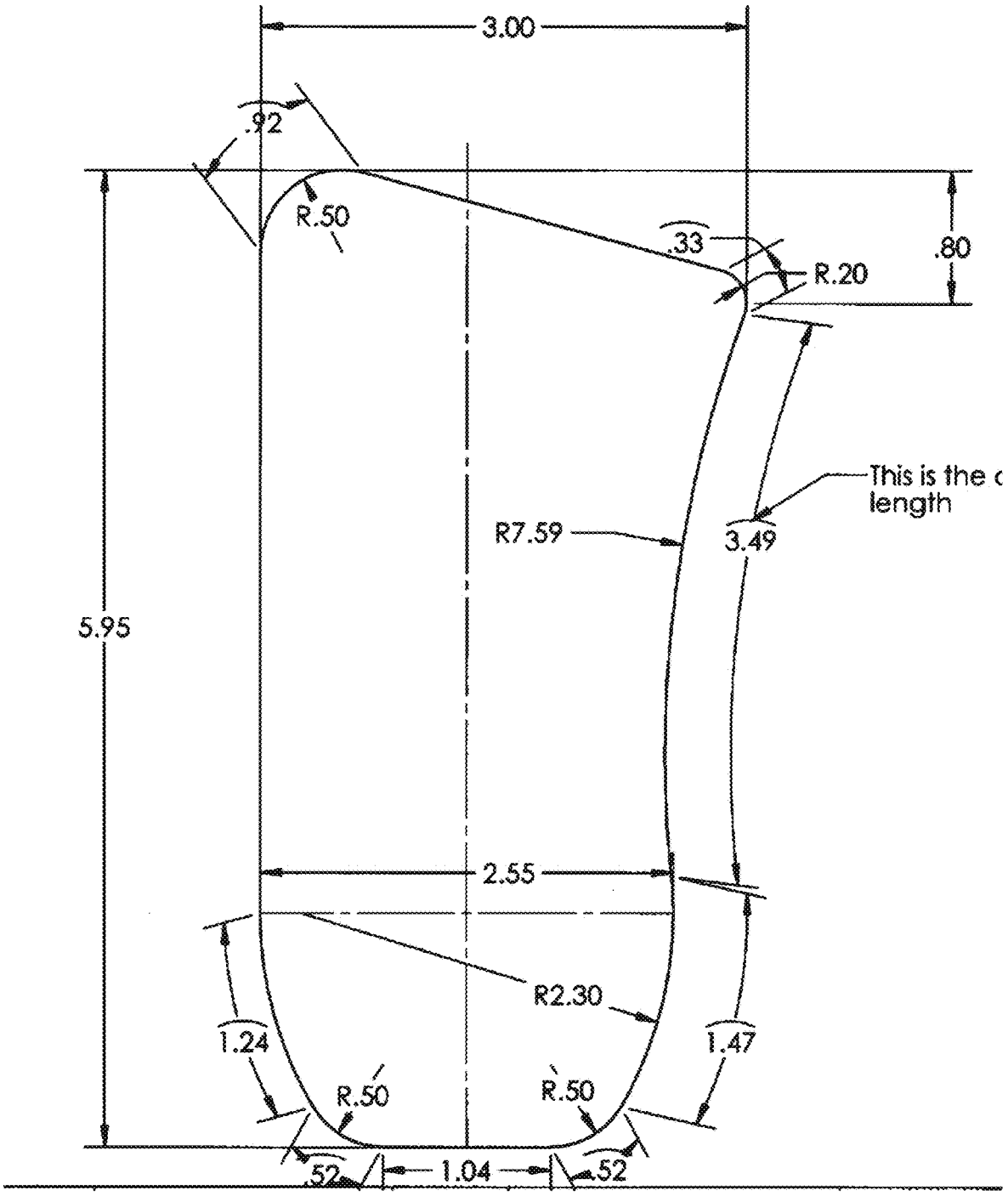
FIG. 8 is a schematic of a top view of an embodiment of the insole of the present invention.
Figure 9:
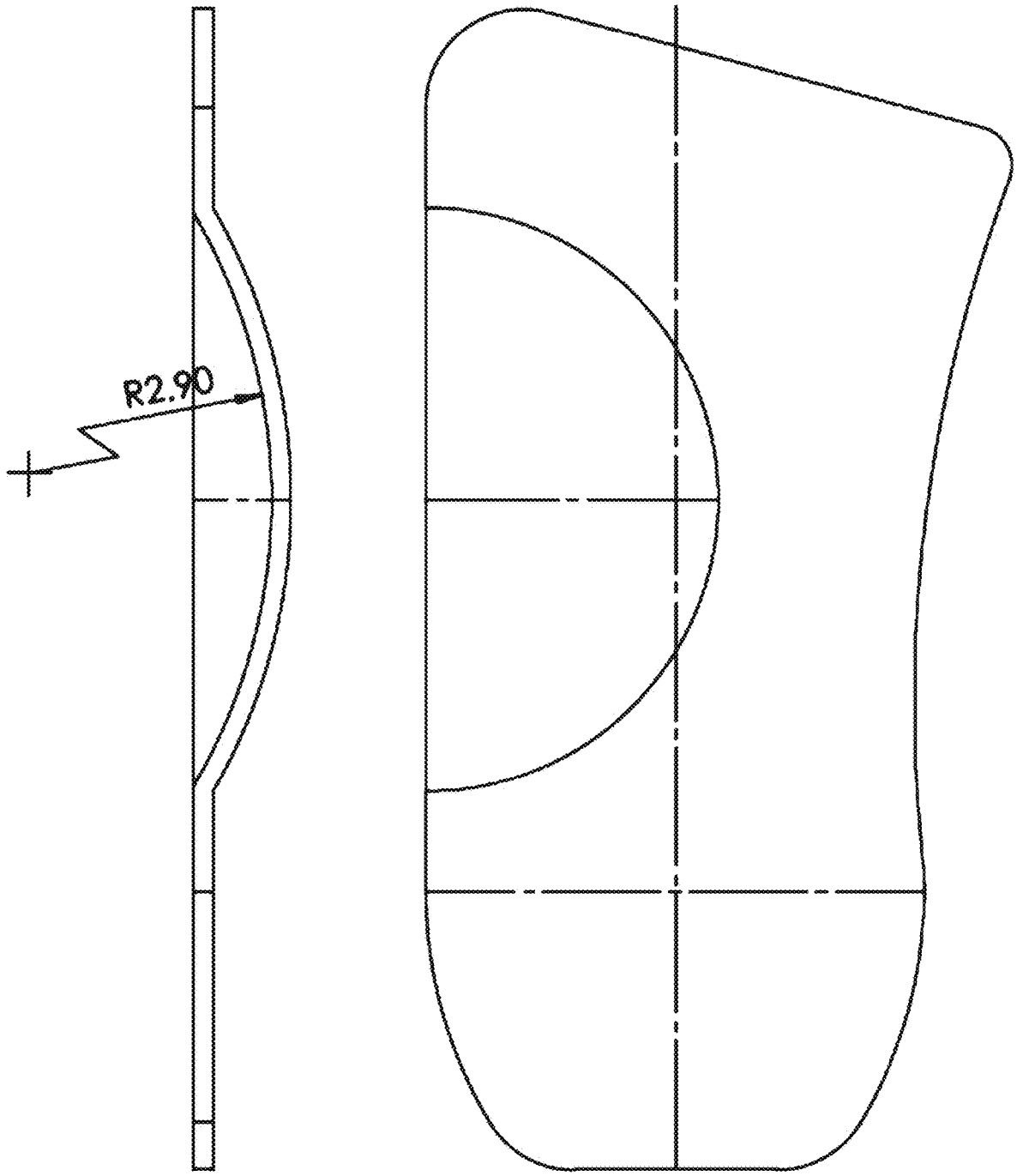
FIG. 9 is a schematic of a side view of an embodiment of the insole of the present invention.

FIGS. 8 and 9 show schematics of a top view and a side view of an embodiment of the insole of the present invention. In a preferred embodiment, the present invention is constructed out of ultra-high molecular weight polyurethane. However, the present invention may also be constructed out of a thermoplastic elastomer, a rubberized material, or some combination thereof.

In various embodiments, the present invention comprises an insert for a shoe. This insert is substantially similar to the insole described above, except the insole will be placed inside a fabric sleeve or similar apparatus, and will optionally have some padding disposed on said top surface, to improve the comfort of a user who is using the present invention.

In some preferred embodiments, the insole of the present invention will self-adjust based on a user's arch. That is, the longitudinal arch support section will have an arch height higher than that of the user, such that a user wearing the insole of the present invention will compress the insole until an equilibrium is met. In some embodiments, the insole will return to its original shape. In other embodiments, the insole will slowly conform to a user's foot after multiple uses.

Preferably, the insole of the present invention will weigh approximately 0.05 pounds. In some embodiments, the insole of the present invention is made by directly molding it from far, formulated, UHMW-PE resin. Alternatively, the insole of the present invention may be made by compressing or extruding a sheet from formulated UHMW-PE resin, stamp an outline of the insole in a flat shape, reheating that stamp for compression molding, and molding the stamp to have the shape of the insole of the present invention. According to an embodiment, the insole is formed from UHMW and/or from 30-100% UHMW-PE. According to an embodiment, the sole includes a lining. According to an embodiment, any lining materials are secured to the top of the insole to give more comfort. The lining materials can be secured to the insole via gluing, sewing, and/or any other suitable method of securing the lining. According to an embodiment, the lining material includes foam, cloth, and/or any other suitable materials. The lining material may be any color of foam and/or fabric.

In a preferred embodiment, the radius of the present invention is 2.9 inches. In another preferred embodiment, the heel receiving portion of the present invention is tapered from its first end to its second end. The present invention also contemplates a method of producing an insole, comprising: compressing a sheet of polymer, having a thickness; stamping said sheet, at least one time, with an insole-shaped stamp to create an insole-shaped impression; removing said impression; placing said impression in an arch-shaped mold; and heating said impression, for compression molding, such that it will take the shape of said arch-shaped mold.

TEST EXAMPLES

Example 1

Figure 10A:
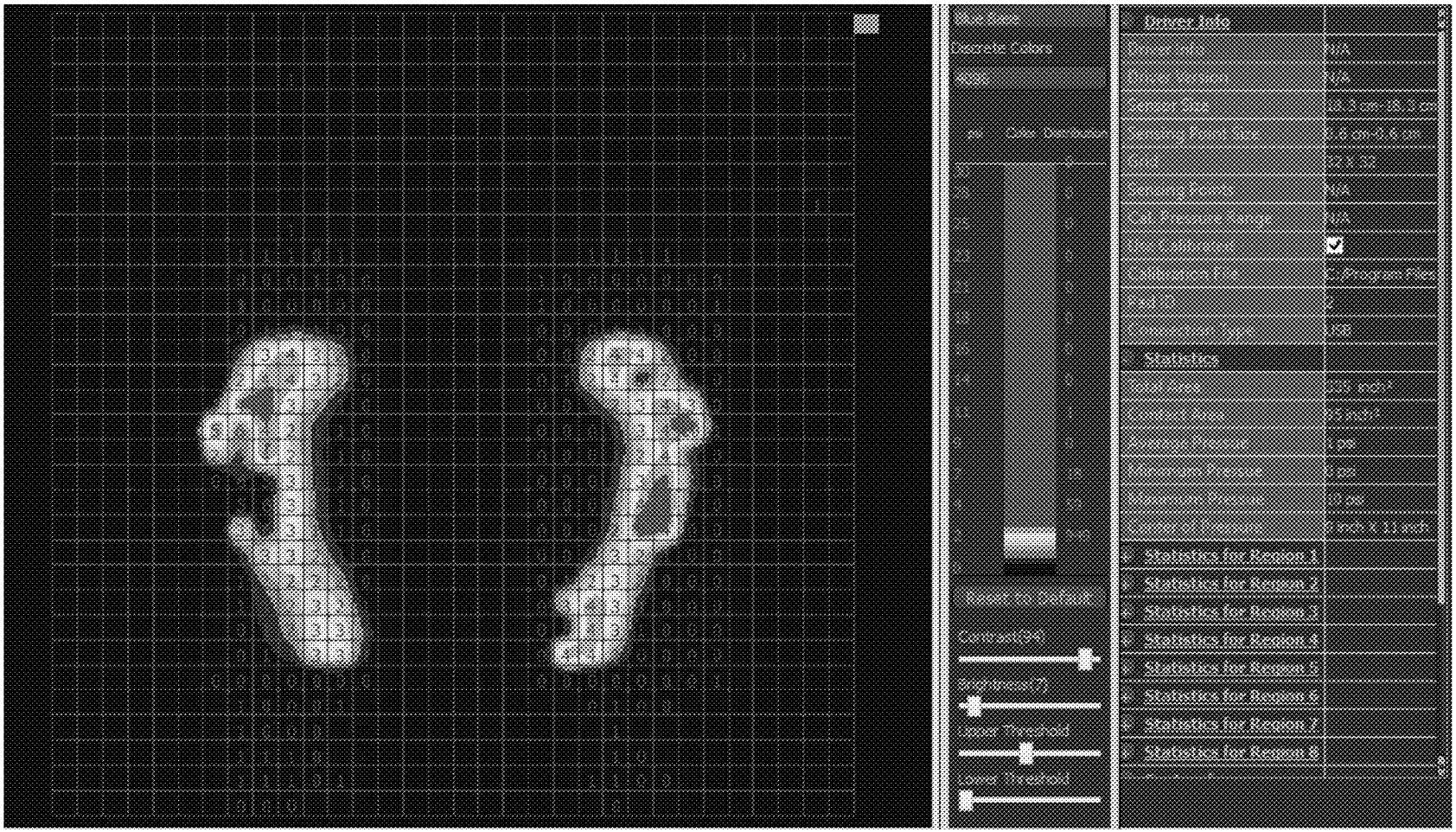
FIG. 10A is a pressure distribution map of a test subject standing without the insole of the present invention.
Figure 10B:
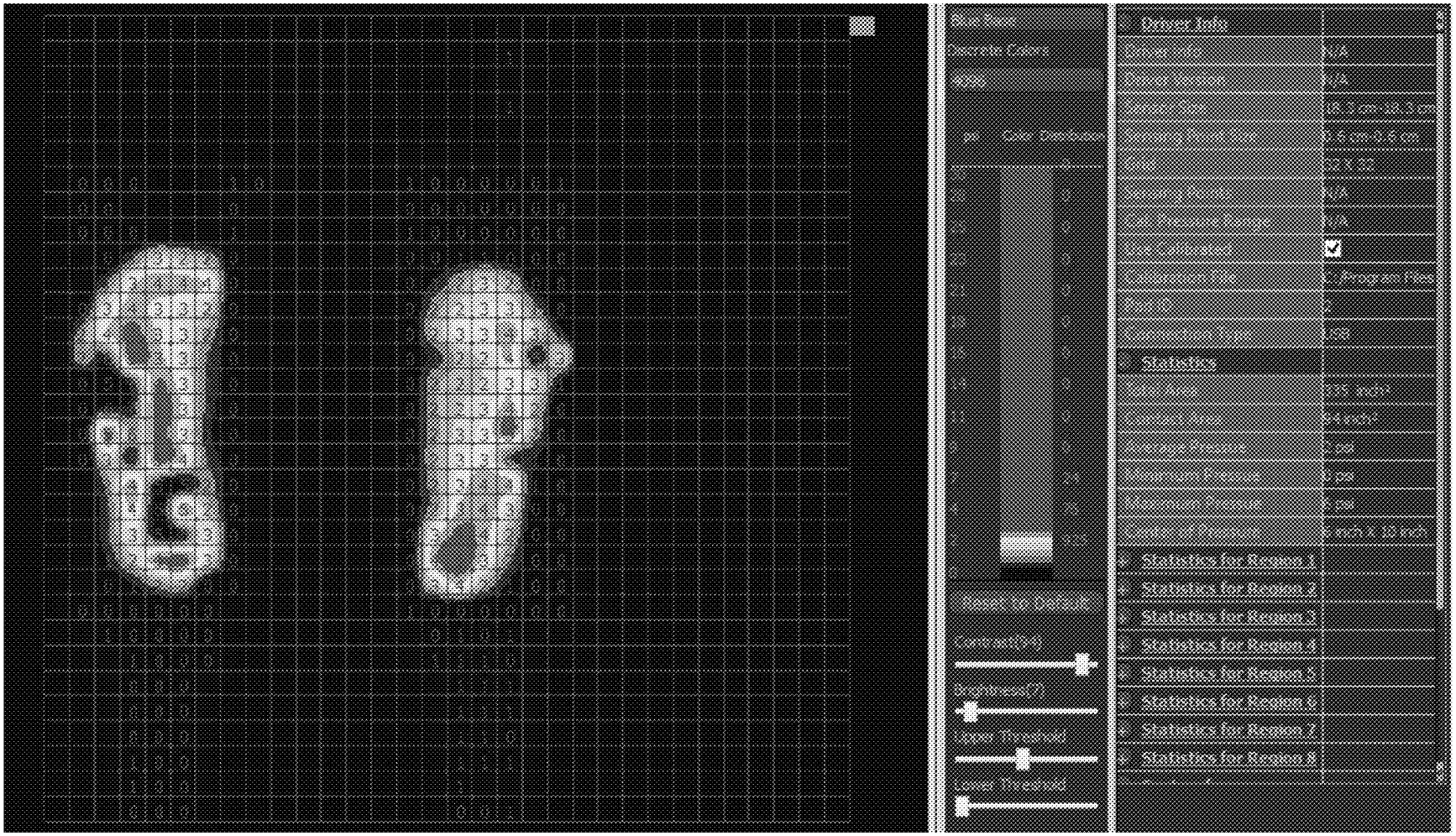
FIG. 10B is a pressure distribution map of a test subject standing with the insole of the present invention.

Referring now to FIGS. 10A and 10B, a pressure distribution map of a test subject standing without the insole of the present invention (FIG. 10A) and with the insoles of the present invention (FIG. 10B) are illustratively depicted, in accordance with embodiments of the present invention.

According to a test study performed, as the test subject stood without the insoles of the present invention, the maximum pressure on the feet was approximately 10 psi. However, as the test subject stood with the insoles of the present invention, the maximum pressure on the feet was approximately 6 psi. Furthermore, as the test subject stood with the insoles of the present invention, the contact area of the feet increased, resulting in a larger distribution of the test subject's weight as the test subject stood. This increase in contact area and decrease in pressure has been shown to reduce pressure on knee joints and foot joints.

Example 2

Figure 11A:
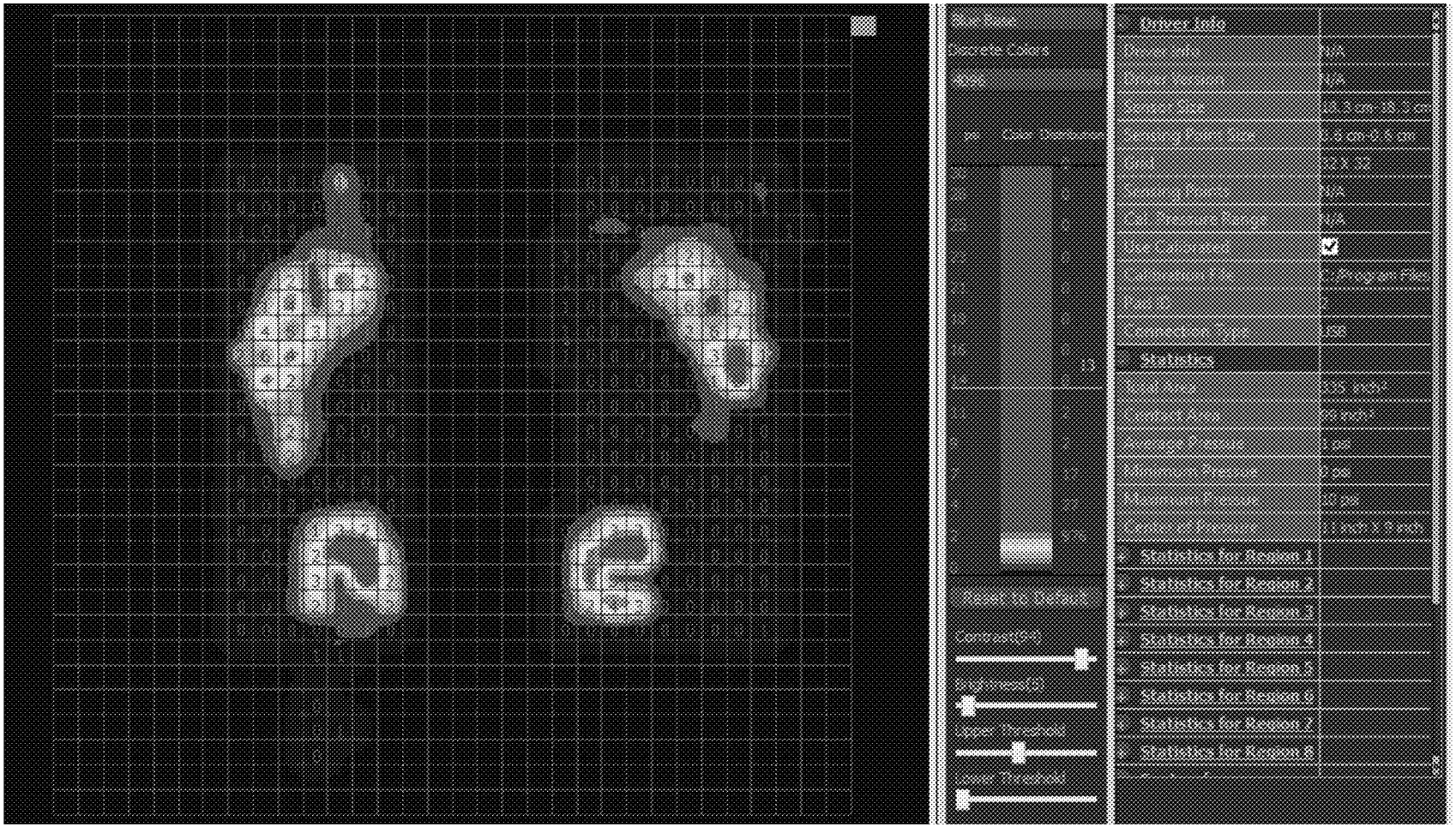
FIG. 11A is a pressure distribution map of a test subject standing without the insole of the present invention.
Figure 11B:
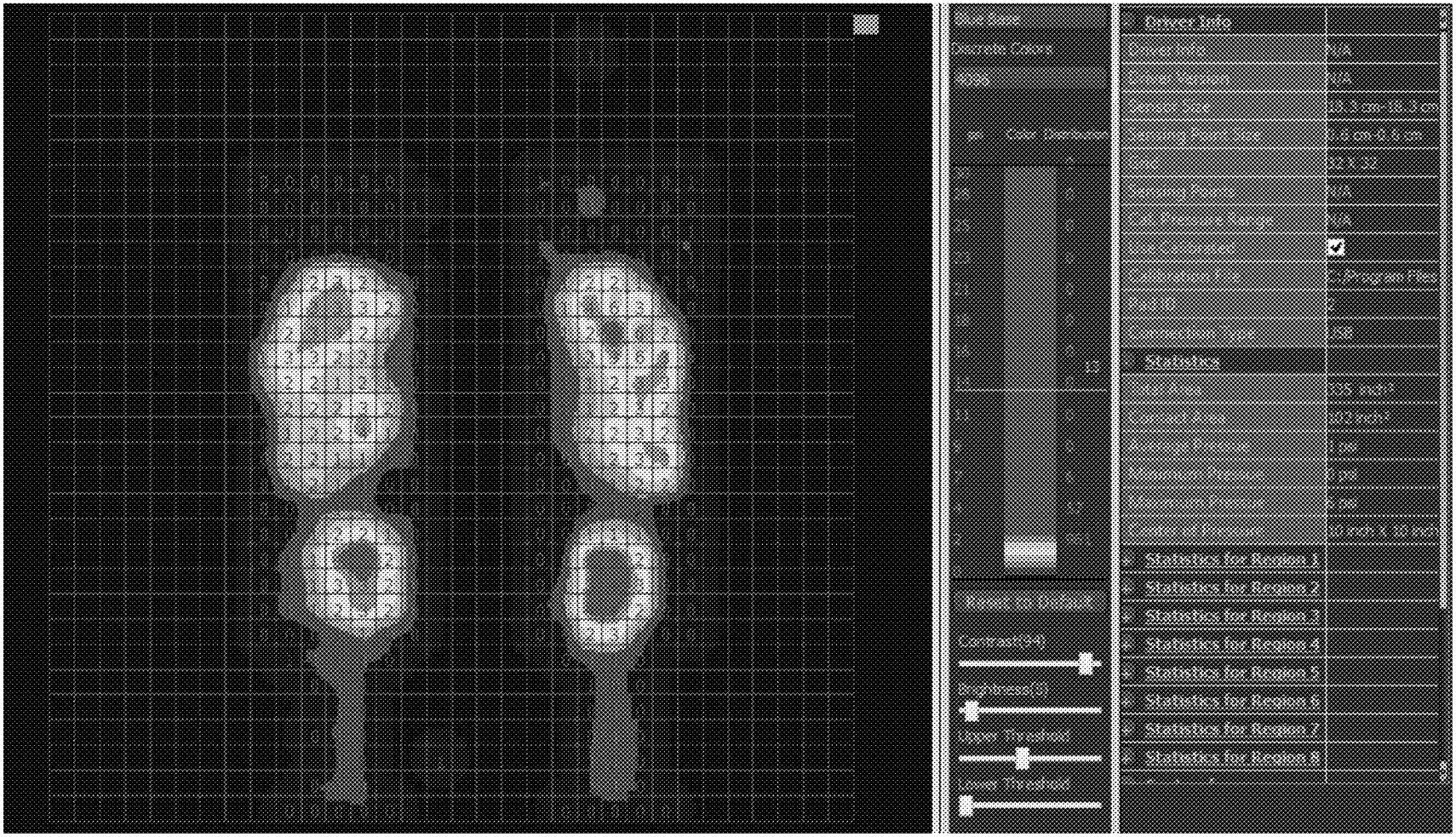
FIG. 11B is a pressure distribution map of a test subject standing with the insole of the present invention.

Referring now to FIGS. 11A and 11B, a pressure distribution map of a test subject standing without the insole of the present invention (FIG. 11A) and with the insoles of the present invention (FIG. 11B) are illustratively depicted, in accordance with embodiments of the present invention.

According to a test study performed, as the test subject stood without the insoles of the present invention, the maximum pressure on the feet was approximately 10 psi. However, as the test subject stood with the insoles of the present invention, the maximum pressure on the feet was approximately 6 psi. The test subject of FIGS. 11A and 11B was a 26 year old male table tennis player. The use of the insoles of the present invention were found not only to reduce the pressure on his feet, but also were found to decrease his foot pain after table tennis practice. Furthermore, the increased surface area of pressure with the insoles of the present invention enabled the test subject to stand more firmly during play.

When introducing elements of the present disclosure or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Therefore, it is intended that the disclosure not be limited to the particular embodiments disclosed.

What is claimed is:

1. An insole, comprising:

a thickness in a range of 0.06-0.15 inches;

a top surface;

a bottom surface;

a heel receiving portion having a first end and a second end;

an anterior transverse arch support section;

a lateral longitudinal arch support section, having a width; and a medial longitudinal arch support section, comprising, a partial spherical cap, said spherical cap having a radius and a height, wherein said medial longitudinal arch support section runs from said first end of said heel receiving portion to said anterior transverse arch support section;

wherein a height of the medial longitudinal arch support section is in a range of 0.2-2 inches and configured to be greater than a height of an arch of a foot of a user;

wherein when the user stands with the insole, the medial longitudinal arch support section is compressed to support the arch of the user; and wherein said insole consists of ultra-high molecular weight polyethylene (UHMW-PE).

2. The insole of claim 1, wherein said insole does not have a toe receiving portion.

3. The insole of claim 1, wherein said bottom surface is disposed with an adhesive.

4. The insole of claim 1, wherein said radius is 2.9 inches.

5. The insole of claim 1, wherein said heel receiving portion is tapered from said first end to said second end.

6. The insole of claim 1, wherein said insole is compressible, but will retain its shape.

7. The insole of claim 1, wherein text, at least one graphic, or both are disposed on said top surface or said bottom surface.

8. An insert, comprising:

an insole, comprising:

a front end;

a thickness in a range of 0.06-0.15 inches;

a top surface;

a bottom surface;

a heel receiving portion having a first end and a second end;

a lateral longitudinal arch support section, having a width and a height; and a medial longitudinal arch support section, comprising, a partial spherical cap, said partial spherical cap having a radius and a height, wherein said medial longitudinal arch support section runs from said first end of said heel receiving portion to said lateral longitudinal arch support section;

wherein the height of the medial longitudinal arch support section is in a range of 0.2-2.0 inches and configured to be greater than a height of an arch of a foot of a user;

wherein when the user stands with the insole, the medial longitudinal arch support section is compressed to support the arch of the user; and wherein said insole consists of ultra-high molecular weight polyethylene (UHMW-PE).

9. The insert of claim 8, wherein said insert is configured to be removably attached to a shoe.

10. The insert of claim 8, wherein said insert is configured to be permanently attached to a shoe.

11. The insert of claim 8 wherein the insert is configured to conform to a foot of a user.

12. The insert of claim 8 wherein an angle formed between a medial edge and an anterior transverse arch support edge is less than 90°.

13. The insert of claim 8 wherein the insert tapers toward a midline of the insert between the heel receiving portion and an anterior transverse arch support section along the longitudinal arch support section.

* * * * *